US008281727B2

(12) United States Patent
Gonen

(10) Patent No.: US 8,281,727 B2
(45) Date of Patent: Oct. 9, 2012

(54) WIND-PROPELLED VEHICLE INCLUDING WING-SAIL

(76) Inventor: Ilan Gonen, Ramat-HaSharon (IL)

( * ) Notice: Subject to any disclaimer, the term of this patent is extended or adjusted under 35 U.S.C. 154(b) by 162 days.

(21) Appl. No.: 12/831,294

(22) Filed: Jul. 7, 2010

(65) Prior Publication Data

US 2012/0006243 A1 Jan. 12, 2012

(51) Int. Cl.
*B63H 9/04* (2006.01)

(52) U.S. Cl. ..... 114/102.29

(58) Field of Classification Search ..... 114/39.12, 114/39.21, 39.29, 102.1, 102.12, 102.13, 114/102.15, 102.16, 102.22, 102.29, 102.32, 114/102.33, 89, 90, 92, 95, 96, 97, 98
See application file for complete search history.

(56) References Cited

U.S. PATENT DOCUMENTS

| | | | | |
|---|---|---|---|---|
| 2,484,687 | A | 10/1949 | Carl, Jr. | |
| 4,388,888 | A | 6/1983 | Gushurst, Jr. | |
| 4,418,632 | A | 12/1983 | Yoshimi et al. | |
| 4,624,203 | A | 11/1986 | Ferguson | |
| 4,685,410 | A | 8/1987 | Fuller | |
| 4,703,707 | A | 11/1987 | Anderson | |
| 4,856,449 | A | 8/1989 | Walker | |
| 4,895,091 | A | 1/1990 | Elmali et al. | |
| 5,271,349 | A | 12/1993 | Magrini | |
| 5,575,233 | A | 11/1996 | Walker | |
| 5,622,131 | A | 4/1997 | Walker | |
| 5,799,601 | A | 9/1998 | Peay | |
| 6,141,809 | A | 11/2000 | Lyngholm | |
| 6,431,100 | B2 | 8/2002 | Abshier | |
| 6,863,008 | B2 * | 3/2005 | Gonen | 114/102.26 |
| 7,603,958 | B2 * | 10/2009 | Gonen | 114/102.29 |
| 2004/0069197 | A1 | 4/2004 | Gonen | |
| 2009/0165689 | A1 | 7/2009 | Gonen | |

FOREIGN PATENT DOCUMENTS

| | | |
|---|---|---|
| FR | 2710023 | 3/1995 |
| GB | 2008514 | 6/1979 |
| GB | 2196310 | 4/1988 |
| NL | 1031707 | 10/2007 |
| WO | WO 02/072411 | 9/2002 |
| WO | WO 2009/083948 | 7/2009 |

OTHER PUBLICATIONS

International Preliminary Report on Patentability Dated Jul. 15, 2010 From the International Bureau of WIPO Re. Application No. PCT/IL2008/001250.

International Search Report and Written Opinion Dated Feb. 12, 2009 From the International Searching Authority Re: Application No. PCT/IL2008/001250.

(Continued)

*Primary Examiner* — Daniel Venne

(57) ABSTRACT

A wind-propelled vehicle, includes: a vertical mast assembly having a lower end rotatably mounted about a vertical axis on the vehicle; and a wing sail carried by the vertical mast assembly for propelling the vehicle, including a fore sail panel defining the leading edge of the wing-sail, and a pair of aft sail panels attached to a pair of booms defining the sides and trailing edge of the wing-sail. The vertical mast assembly includes a pair of vertically-extending posts connected together at their upper ends, diverging apart at their lower ends, and connected together at the diverging lower ends to define an "A" configuration frame. The diverging lower ends of the pair of posts are rotatably mounted on the vehicle.

11 Claims, 9 Drawing Sheets

OTHER PUBLICATIONS

Notice of Allowance Dated Jul. 14, 2009 From the US Patent and Trademark Office Re.: U.S. Appl. No. 12/003,758.
Official Action Dated Mar. 24, 2009 From the US Patent and Trademark Office Re.: U.S. Appl. No. 12/003,758.
Response Dated Nov. 8, 2011 to Examination Report of Aug. 19, 2011 From the Intellectual Property Office of New Zealand Re. Application No. 586805.
Examination Report Dated Dec. 21, 2011 From the Intellectual Property Office of New Zealand Re. Application No. 586805.
Examination Report Dated Aug. 19, 2011 From the Intellectual Property Office of New Zealand Re. Application No. 586805.
European Search Report and the European Search Opinion Dated Nov. 30, 2011 From the European Patent Office Re. Application No. 11173128.7.
Communication Pursuant to Article 96(2) Dated Nov. 30, 2006 From the European Patent Office Re.: Application No. 02702690.5.
Communication Pursuant to Article 94(3) EPC Dated Jan. 25, 2010 From the European Patent Office Re.: Application No. 02702690.5.
Communication Pursuant to Article 96(2) EPC Dated Nov. 30, 2006 From the European Patent Office Re.: Application No. 02702690.5.
Communication Under Rule 71(3) EPC Dated Jul. 18, 2011 From the European Patent Office Re.: Application No. 02702690.5.
Examination Report Dated Jul. 13, 2011 From the Intellectual Property Office of New Zealand Re. Application No. 593939.
Examination Report Dated Nov. 27, 2006 From the Intellectual Property Office of New Zealand Re.: Application No. 529216.
Examiner's Report Dated Dec. 11, 2006 From the Australian Government, IP Australia Re. : Application No. 2002236181.
Examiner's Report Dated Sep. 11, 2007 From the Australian Government, IP Australia Re. : Application No. 2002236181.
International Preliminary Examination Report Dated Aug. 1, 2006 From International Preliminary Examining Authory Re.: Application No. PCT/IL02/00183.
Response Dated May 13, 2010 to Communication Pursuant to Article 94(3) EPC of Jan. 25, 2010 From the European Patent Office Re.: Application No. 02702690.5.
Response Dated Apr. 14, 2004 to Written Opinion of Feb. 18, 2004 From the International Searching Authority Re.: Application No. PCT/IL02/00183.
Supplementary European Search Report Dated Sep. 21, 2006 From the European Patent Office Re.: Application No. 02702690.5.
Dynawing "Home of the Soft Wing Sail", www.dynawing.com.
Communication Pursuant to Rules 70(2) and 70a(2) EPC and Reference to Rule 39(1) EPC Dated Jan. 16, 2012 From the European Patent Office Re. Application No. 11173128.7.

* cited by examiner

WIND-PROPELLED VEHICLE INCLUDING WING-SAIL

FIELD AND BACKGROUND OF THE INVENTION

The present invention relates to wind-propelled vehicles, and particularly to such vehicles including soft wing-sails for propelling the vehicle, such as described in my prior U.S. Pat. Nos. 6,863,008 and 7,603,958, the contents of which are incorporated herein by reference.

In order to have a wing-sail effective in all wind directions, the wing-sail has to rotate towards the wind direction and to maintain the proper angle of attack. This can be achieved by using a free standing and rotating mast that supports, and is secured to, the wing such that the wing and the mast rotate together towards the wind.

Free standing masts in large boats encounter two problems: when large masts are in use, free standing and rotating masts need extensive reinforcement in order to take all the loads of the wing-sails, as well as to prevent the mast from bending, both caused by the movement of the boat in the open sea; the result is a large diameter and wall thickness mast that is heavy and expensive. When large, soft wing-sails are made of sailcloth wrapped around the mast, the sailcloth is divided into three different sail panels, which generally require mounting tracks for each of the sail panels both sides of the mast, and special spreaders for slidably mounting the wing-sail on the tracks; see, for example, my above-cited U.S. Pat. No. 7,603,958.

Objects And Brief Summary of the Invention

An object of the present invention is to provide a wind-propelled vehicle having advantages in one or more of the above respects.

According to a broad aspect of the present invention, there is provided a wind-propelled vehicle, comprising: a vertical mast assembly having a lower end rotatably mounted about a vertical axis on the vehicle; and a wing sail carried by the vertical mast assembly for propelling the vehicle, including a fore sail panel defining the leading edge of the wing-sail, and a pair of aft sail panels defining the sides and trailing edge of the wing-sail; characterized in that the vertical mast assembly includes a pair of vertically-extending posts connected together at their upper ends, diverging apart at their lower ends, and connected together at the diverging lower ends to define an "A" configuration; a rotatable support for the diverging lower ends of the pair of posts on the vehicle; and a separate boom fixed to the lower end of each of the pair of posts connected to the aft sail panels of the wing-sail enabling each aft sail panel to be hoisted and reefed.

In the preferred embodiment of the invention described below, the rotatable mounting includes a rotatable horizontal plate having an upper surface to which the lower diverging ends of the posts are mounted, and an under surface to which is fixed a shaft rotatably mounted on the vehicle.

The vehicle includes a hull and a deck, and the vertical mast assembly is mounted in a free-standing manner with the rotatable plate substantially aligned with the deck, and with the shaft penetrating the deck and rotatably mounted within the hull.

According to further features in the described preferred embodiment, the pair of vertically-extending posts are connected together at their diverging lower ends by one or more reinforcing struts. In addition, the mast assembly is supported in the vertically-extending position by shrouds connecting together opposite sides of the upper part of the vertical mast assembly.

As will be described more particularly below, such a vertical mast assembly is relatively rigid and less flexible than a free-standing mast, and tends to bend less to port and starboard.

The foregoing construction of the mast assembly in the present invention is to be sharply distinguished from the bi-pod mast constructions described in several prior art patents, such as U.S. Pat. Nos. 6,427,619, 6,390,013 and 4,653,417 where, among other differences, such bi-pod mast assembly constructions are fixed to the deck, rather than being rotatably mounted with respect to the deck.

As indicated earlier, the preferred embodiment of the invention described below is a wind-propelled vehicle constructed similar to that described in my prior U.S. Pat. No. 7,603,958. Thus, in the present construction, the wing-sail is a light-weight, soft, wing-sail constituted of a fore sail panel and two separate aft sail panels; but instead of mounting the tracks on spreaders fixed to the mast, the two diverging posts of the vertical mast assembly mount the pair of tracks along opposite sides thereof and slidably receive slider assemblies fixed to the sail panels to permit hoisting and reefing of the wing-sail.

As will be described more particularly below, the described preferred embodiment of the invention not only provides a vertical mast assembly which is relatively rigid and less flexible than a free-standing mast, and which tends to bend less to port and starboard, but also provides a wing-sail of a light-weight and simple constructions which permits the wing-sail to be hoisted, reefed, and lowered, either as one wing-sail unit, or each of the sail panels. The higher efficiency capability of such a light-weight, soft, wing-sail enables the vehicle to attain higher speeds of travel and to point higher upwind, and at the same time, to reduce the size of the sails and rigging and to reduce the weight of the vehicle. It also enables safe and easy operation of a vehicle driven by the wind.

Further features and advantages of the invention will be apparent from the description below.

BRIEF DESCRIPTION OF THE DRAWINGS

The invention is herein described, by way of example only, with reference to the accompanying drawings, wherein.

It is to be understood that the foregoing drawings, and the description below, are provided primarily for purposes of facilitating understanding the conceptual aspects of the invention and possible embodiments thereof, including what is presently considered to be a preferred embodiment. In the interest of clarity and brevity, no attempt is made to provide more details than necessary to enable one skilled in the art, using routine skill and design, to understand and practice the described invention. It is to be further understood that the embodiments described are for purposes of example only, and that the invention is capable of being embodied in other forms and applications than described herein.

Description of the Prior Art Wing-Sail of FIGS. 1-8

As indicated above, a preferred embodiment of the invention of the present application is when it is implemented in a prior art wind-propelled vehicle similar to that described in my prior U.S. Pat. No. 7,603,958. Accordingly, to better understand the invention of the present application, a detailed description of the prior art wing-sail of my U.S. Pat. No. 7,603,958 is first described with respect to FIGS. 1-8.

Figure 1:
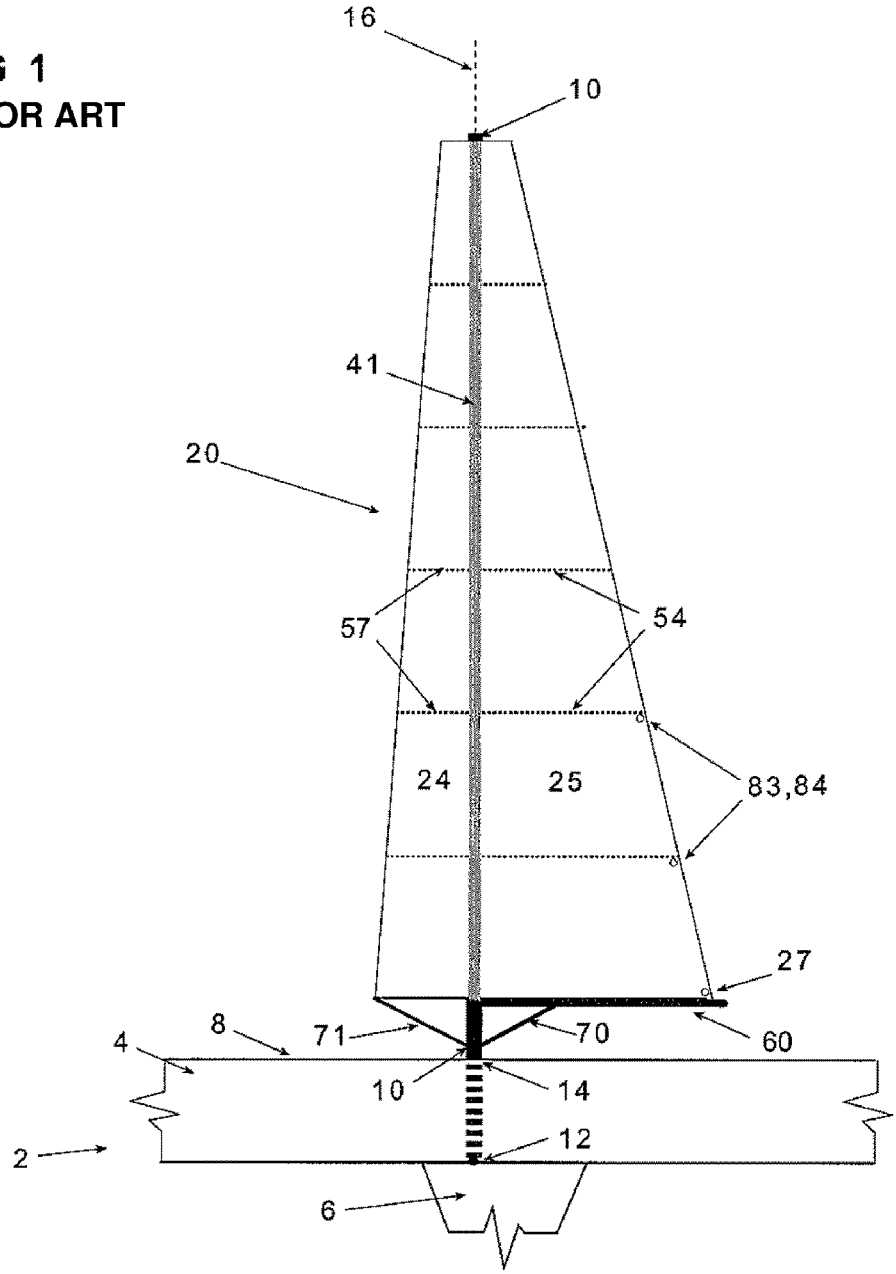
FIG 1 PRIOR ART
FIG. 1 is a diagrammatic side-elevational view of a prior art wind-propelled vehicle including a light-weight soft wing-sail constructed in accordance with my prior U.S. Pat. No. 7,603,958 for propelling the vehicle.

The prior art wind-propelled water vehicle illustrated in FIG. 1, is generally designated 2. It includes a hull 4, a keel 6, a deck 8, and a free-standing and rotatable mast, generally designated 10, vertically mounted for rotation by means of a ball 12 at the level of keel 6, and a roller bearing 14 at the level of the deck 8, such as to permit rotation of the mast about its vertical axis 16.

Vertical mast 10 carries a light-weight, soft wing-sail, generally designated 20, for propelling the vehicle. As shown particularly in FIG. 2, wing-sail 20 is supported on mast 10 such as to assume a selected airfoil shape having a leading edge defined by a U-shaped panel 24 fore of the mast, and a trailing edge aft of the mast defined by two spaced side panels 25, 26. As shown particularly in FIGS. 1, 2 and 6, the lower aft side of the trailing edge side panels 25, 26 includes clews 27, 28.

The selected airfoil shape of the wing-sail 20 is effected by a spreader assembly, including upper spreaders 31*a*, 31*b* fixed to the upper end of mast 10, lower spreaders 32*a*, 32*b*, fixed to the lower end of the mast, and intermediate spreaders 33*a*, 33*b*, fixed at an intermediate portion of the mast. Three spreaders would be suitable for a relatively small vessel, but it will be appreciated that the number of spreaders would depend on the size of the vessel. For example, a medium-sized vessel including five spreaders has also been constructed.

Figure 2:
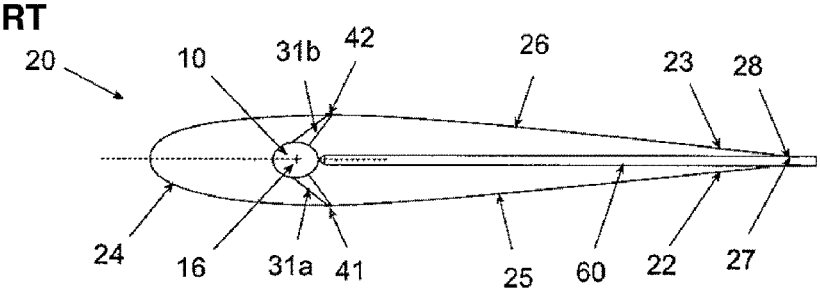
FIG 2 PRIOR ART
FIG. 2 is a diagrammatic plan view illustrating the prior art wing-sail of FIG. 1.
Figure 3:
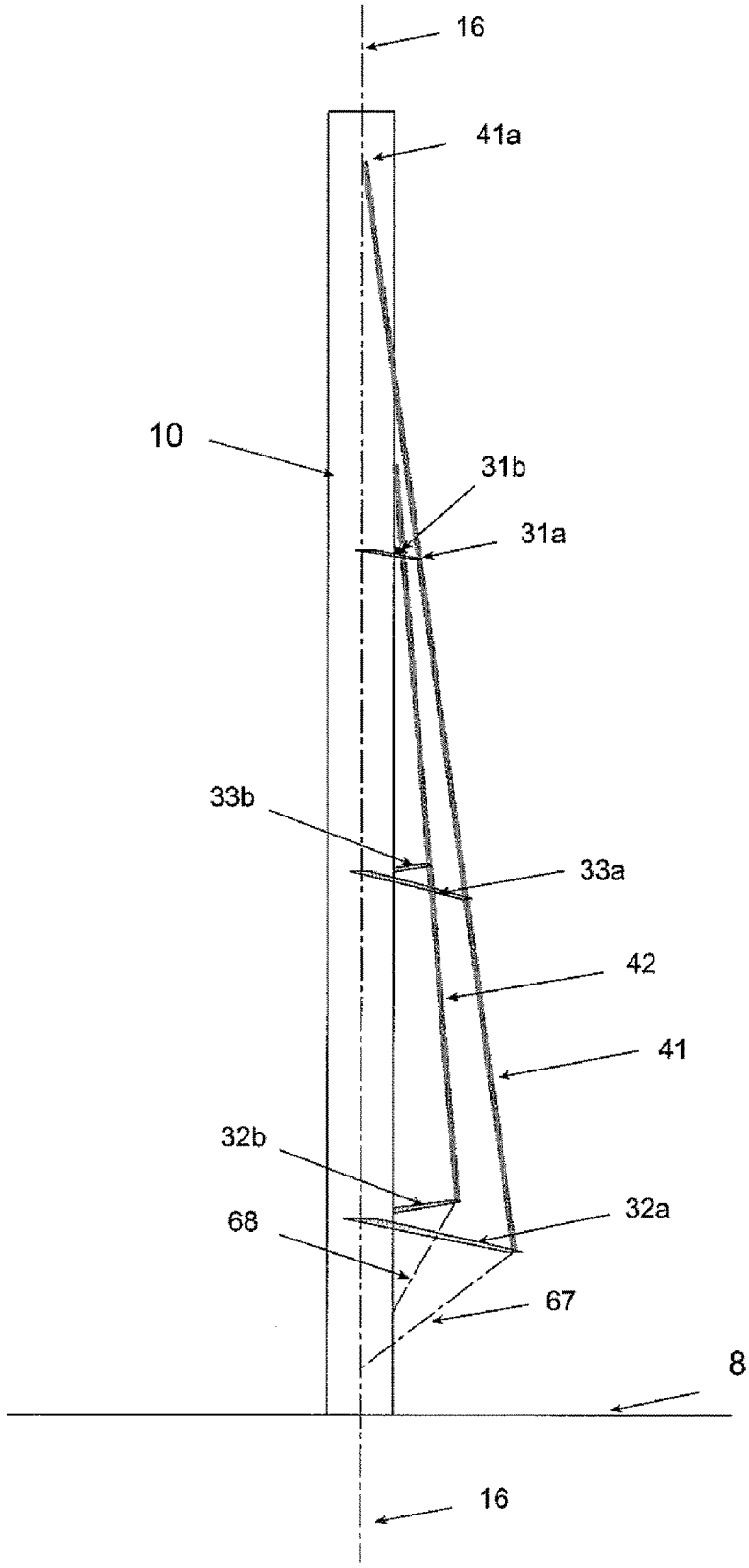
FIG 3 PRIOR ART
FIG. 3 is a side-elevational view of the structure of the prior art wing-sails of FIGS. 1 and 2 attached to the mast.
Figure 4:
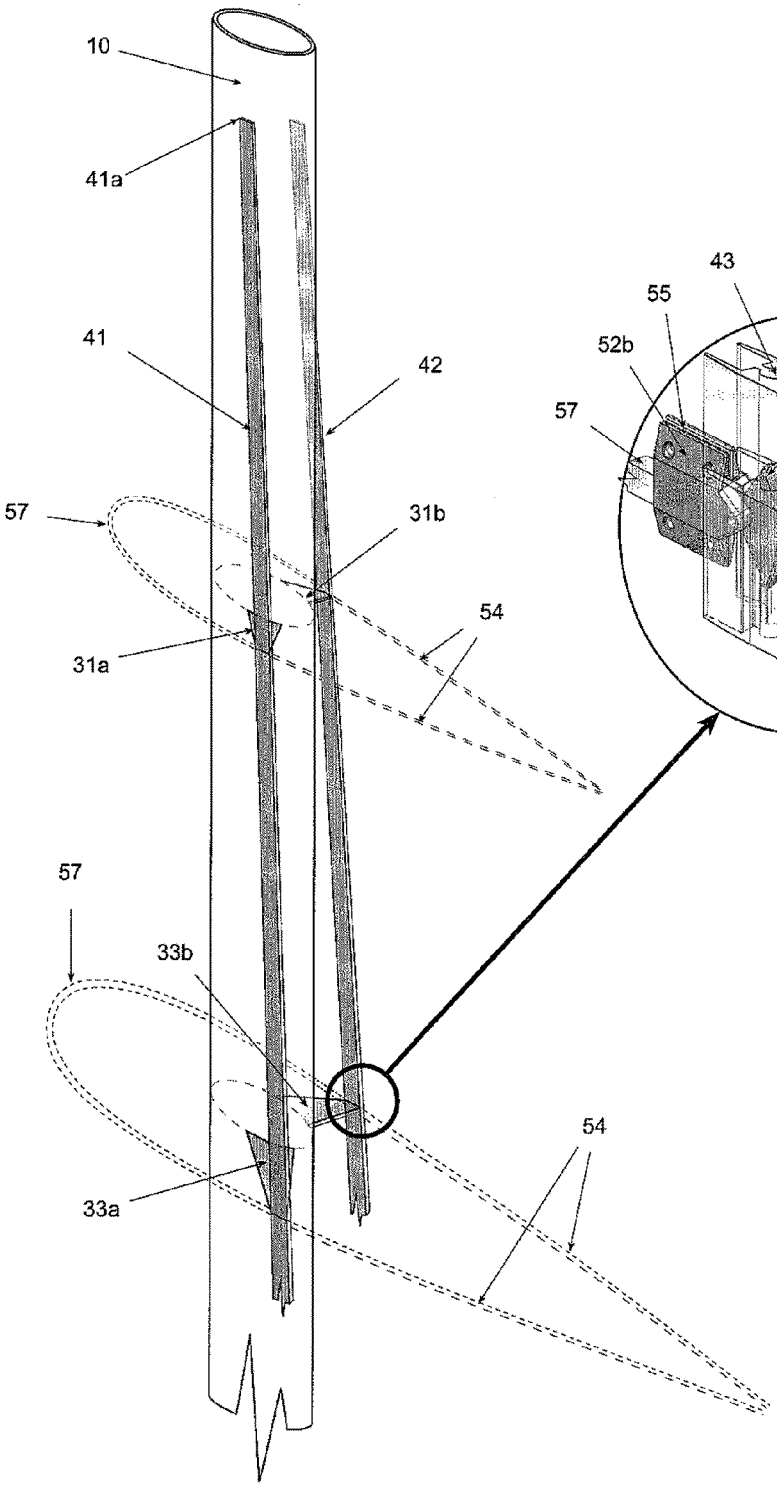
FIG 4 PRIOR ART
FIG. 4 is a diagrammatic fractional view of the prior art wing-sail illustrating the upper end of the mast, spreaders, tracks, battens and particularly the attachment of the wing-sail thereto.

As shown in FIG. 2 the upper spreaders 31*a*, 31*b* are fixed to the upper end of mast 10 and are swept-back to support the wing-sail 20 and to define the desired airfoil shape. Corresponding spreaders 32, 33, are of similar construction, except that their respective lengths are of longer dimension to support the wing-sail 20 and to maintain the airfoil proportions in the triangular configuration illustrated in FIG. 1.

The illustrated prior art wing-sail further includes a pair of tracks 41, 42 (FIGS. 4, 5) extending along opposite sides of the mast 10, and fixed to the upper and lower spreaders 31, 32, and also to all intermediate spreaders 33 if provided. The upper end of each of the tracks 41, 42 is secured to the mast 10 at securement points 41*a*. In addition, since the spreaders increase in length from the upper spreaders 31*a*, 31*b* towards the lower spreaders 32*a*, 32*b*, the two tracks 41, 42 are mounted to the opposite sides of the mast 10 along axes which diverge from the upper end towards the lower end of the vertical rotary axis 16 of mast 10.

Slider assemblies, each generally designated 50 (FIG. 5), are fixed to the sail panels 24, 25 and 26, of wing sail 20, and are slidable along the tracks 41, 42 to permit the sail panels to be hoisted and reefed independently, or together if so desired. Each track 42 (and similarly each track 41) is formed with a fore groove 43 and an aft groove 44. Each groove receives a slider assembly 50, including a slider element 51*a*, 51*b*, slidable along the respective groove, and a sail panel securing element 52*a*, 52*b*, for receiving and securing the respective sail panel. Each sail panel securing element 52*a*, 52*b*, includes a batten receptacle 53, for receiving the batten 54, 57, of the respective sail panel, and a pair of opposed slots 55, 56, for receiving the respective edges of the sail panel.

Figure 5:
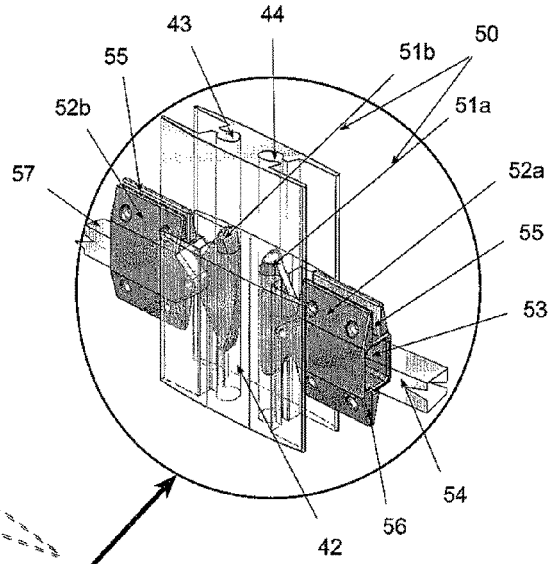
FIG 5 PRIOR ART
FIG. 5 is an enlarged fragmentary view of the prior art wing-sail more particularly illustrating the encircled portion of FIG. 4, namely one of the attachment points of the wing-sail so as to be slidable along its respective track.
Figure 6:
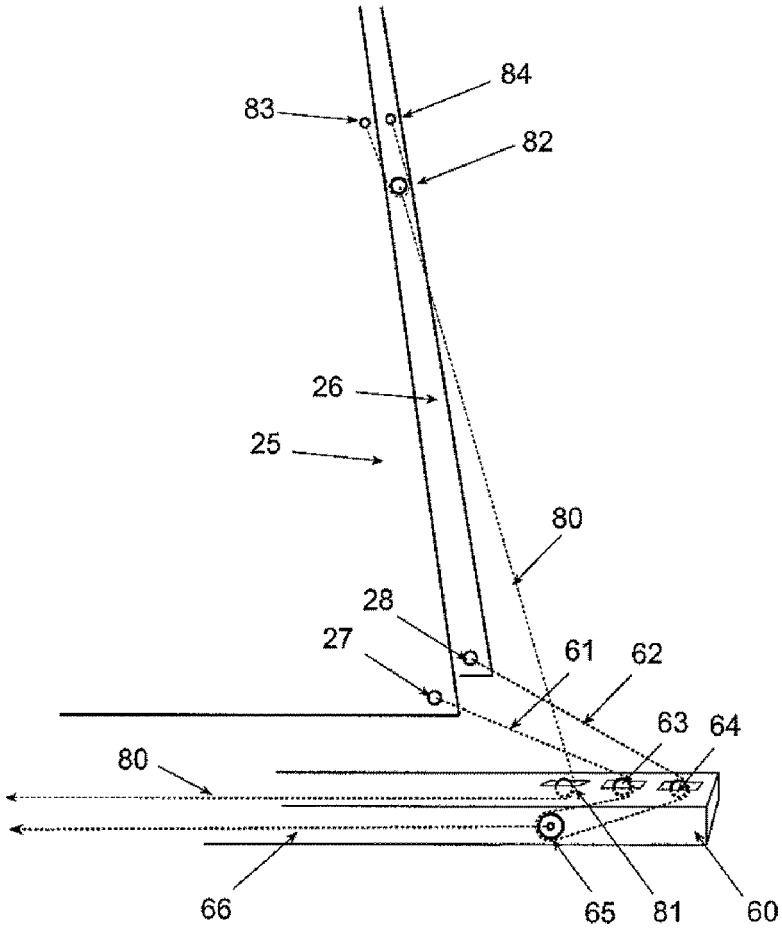
FIG 6 PRIOR ART
FIG. 6 is a diagrammatic view of the prior art wing-sail illustrating the aft side of the boom that is pivotally coupled to the mast; an outhaul line coupled through a block to the clews of both trailing edges of the wing-sail such as to permit even rearward tension and independent siding of each of the trailing edges relative to the book; and also the reefing system for reefing the wing-sail and having the same features of even tension and independent trailing edge sliding relative to the boom when reefed.

FIG. 5 illustrates slider 51*a* slidable within the aft groove 44 of the track, and slider 51*b* slidable within the fore groove 43 of the track. The batten receptacles would be appropriately dimensioned to accommodate their respective battens 54,57. The batten 57 on the front sail panel are flexible in the middle region permitting the batten to assume a U-shape defining the leading edge of the wing-sail, and are stiffer at the aft ends received within their respective receptacles.

The illustrated prior art vehicle further comprises a boom, generally designated 60, and pivotally mounted to the lower end of mast 10. The clews 27, 28 of the two side sail panels, 25, 26 are secured to the boom by tensioning lines 61, 62 wound over sheaves 63, 64, coupled to the boom by a block 65 pulled by an outhaul line 66 to maintain even tension on both clews. Outhaul line 66, acting on tension lines 61, 62 coupled to the two clews 27, 28 through block 65 and sheaves 63, 64, permit changing the angle between the center lines of the leading edge and the center line of the trailing edge of the wing-sail. The foregoing arrangement permits the windward trailing edge clew to slide backward relative to the boom, and the leeward trailing edge clew to slide forward relative to the boom, maintaining even tension on both clews, when the airfoil shape is trimmed by changing the angle between boom 60 and the mast 10.

The structure comprised of mast 10, tracks 41, 42, spreaders 31, 32, 33 and two tension cables 67, 68 (FIG. 3) at the outer ends of the lower spreaders 32 to the bottom of mast 10, provide a stiff and light-weight structure for supporting the mast from whipping.

Figure 7:
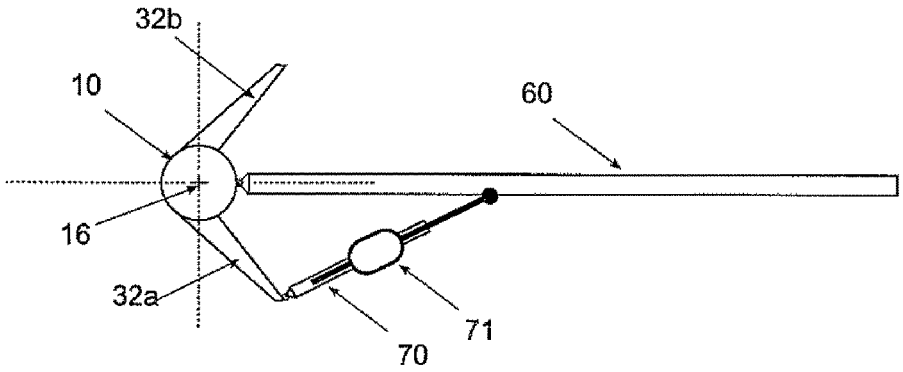
FIG 7 PRIOR ART
FIG. 7 is a diagrammatic plan view of the prior art wing-sail illustrating the ram secured to the book and to the lower spreader to pivot the boom and thereby trim the angle defined by the center lines of the leading and trailing edges of the wing-sail.

As shown particularly in FIG. 7, the illustrated prior art vehicle further includes a ram, generally designated 70, secured to the lower spreader 32 and to the boom to permit fixing the leading edge of the wing-sail to the trailing edge of the wing-sail, and thereby to prevent spontaneous change of the angle between the center line of the leading edge and the center line of the trailing edge. A motor, e.g., hydraulic or electric, enables the effective length of the ram to be changed, and thereby permits changing and trimming of the angle according to a desired airfoil shape.

The illustrated prior art vehicle further includes a reefing line 80 (FIG. 6) coupled via a sheave 81 on boom 60, and by a block 82 to two reefing points 83, 84 of the trailing edges 25, 26 to permit the sail panels to be reefed together and, to independently slide forward and backward along the boom, maintaining even tension on both reefing points, when the airfoil shape is changed. A separate reefing line (not seen in FIG. 8) is provided for the front sail panel 24 to permit that panel to be reefed independently. Because of operational convenience, there is one reefing line for the leading edge sail panel, and only one reefing line for the two trailing edge sail panels.

Figure 8:
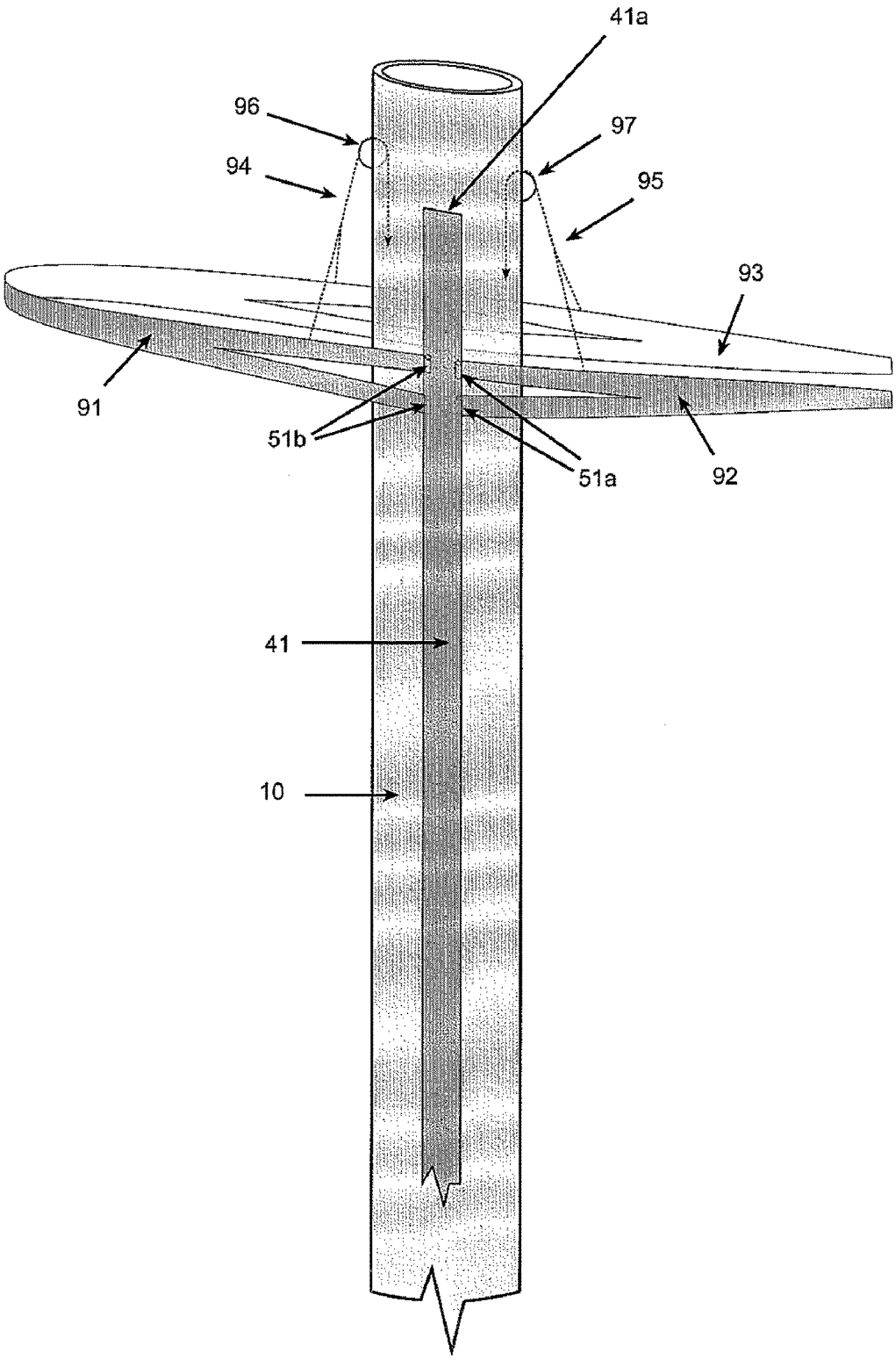
FIG 8 PRIOR ART
FIG. 8 diagrammatically illustrates the headboards at the upper end of the prior art wing-sail of FIGS. 1 and 2.

FIG. 8 illustrates the headboard at the upper end of the wing-sail which is made of solid material. It is constituted of three parts: the leading edge 91, the left trailing edge 92, and the right trailing edge 93. Three sail panels 24, 25, 26, are secured to their respective headboards, 91, 92 and 93.

The leading edge headboard 91 coupled to the leading sail panel 24 is hoisted by a halyard 94 wound over a sheave 96 fixed to the upper end of mast 10; whereas the two trailing edge headboards 92, 93, fixed to the sail panels 25, 26 are hoisted by pulling another halyard 95 wound over a sheave 97 fixed to the upper end of mast 10 at the opposite side from sheave 96.

It is thus seen, for operational simplicity, the side sail panels are hoisted and reefed together, but if the line to each of the side panels is connected independently, the side panels can also be hoisted and reefed independently. Sliders, similar to those illustrated in FIG. 5, are secured to the headboards 91, 92, 93, to permit sliding along tracks 41 and 42 at the opposite sides of the mast.

The manner of operating the prior art wind-propelled vehicle illustrated in FIGS. 1-8 of the drawings will be apparent from the above description. Thus, the structure comprised of mast 10, tracks 41, 42 secured to the mast top and to each of the swept-back spreaders 31, 32, 33 and tensioning cables 67, 68, secured to the mast bottom as shown particularly in FIG. 3, carry the wing-sail 20 and stiffen the mast 10 so as to prevent the top of the mast from whipping. The three sail panels, 24, 25, 26 define the wing-sail skin, and the airfoil proportion and shape are defined by the length of the boom 60, of the spreaders 30 and of the leading edge battens. The sliders 50, secured to the sail panels 24-26 via the batten receptacles 53 of each slider, as shown particularly in FIG. 5, slide up and down within grooves 43, 44 of the two tracks 41, 42 such as to permit hoisting, reefing and taking down the sail panels. Since the three sail panels 24-26 are actually not connected to each other, the arrangement permits selectively hoisting and reefing each of the sail panels, or alternatively, all the sail panels together.

The tracks 41, 42 (FIG. 5) are shaped so as to cover the sliders 50, and batten receptacles 52*a*, 52*b*, secured to the sail panels 24-26 such that airflow around the wing-sail is streamlined and uninterrupted. Clews 27, 28 (FIG. 6) of the side sail panels 25, 26 are coupled to boom 60 by tension cables 61, 62 such that by pulling outhaul line 66, block 65 is pulled forward and keeps even tension on the cables 61, 62, and even rearward tension on the clews 27, 28. This permits the windward clew and respective trailing edge to move backwards relative to the boom, and the leeward clew and respective trailing edge to move forwards relative to the boom, when the airfoil shape is trimmed by changing the angle between the mast 10 and the boom 60 is changed.

Ram 70 (FIG. 7) is secured to the lower spreader 32 and to boom 60, fixes the leading edge of the wing-sail via the boom to the trailing edge, resulting in one wing-sail unit that rotates with the mast. Ram 70 thus secures the boom 60 to the mast 10 such as to prevent spontaneous change of the angle between them under wind pressure. Motor 71 (e.g., hydraulic or electric) changes the length of ram 70, and thereby permits trimming of the angle between the leading edge axis and trailing edge axis defined by the boom according to the desired airfoil camber.

Further details of the construction and operation of the prior art wind-propelled vehicle illustrated in FIGS. 1-8 are available from U.S. Pat. No. 7,603,958 incorporated herein by reference.

THE PREFERRED EMBODIMENT OF THE PRESENT INVENTION

FIGS. 9-12 illustrate the present invention embodied in a prior art wind-propelled vehicle similar to that illustrated in FIGS. 1-8 and more particularly described in my prior U.S. Pat. No. 7,603,958.

Figure 9:
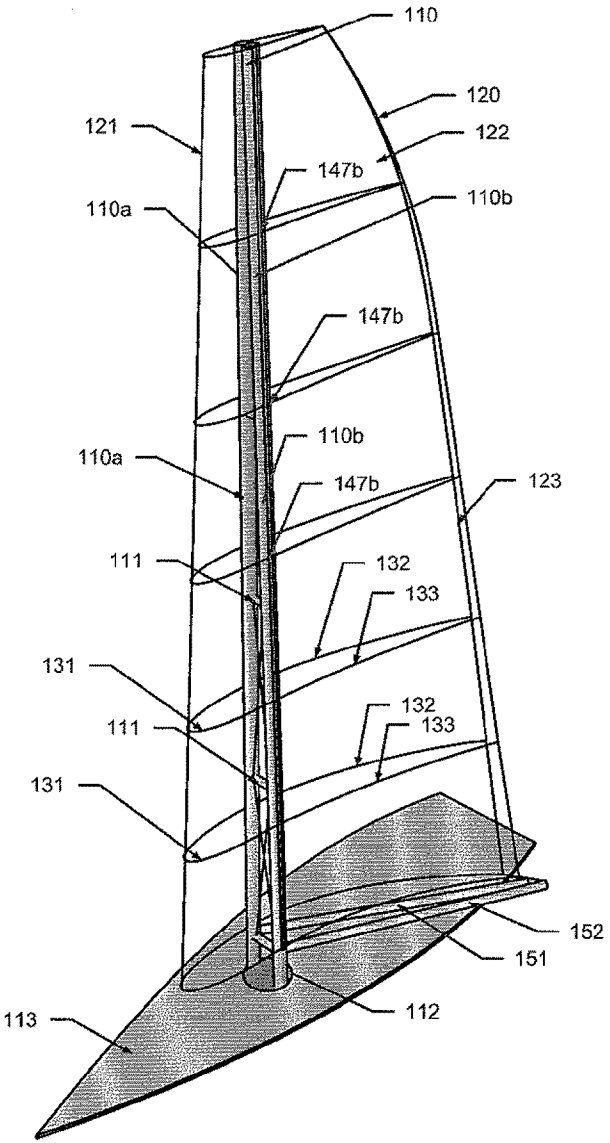
FIG. 9 schematically illustrates a wind-propelled vehicle similar to the prior art of FIGS. 1-8, but modified in accordance with the present invention.
Figure 10:
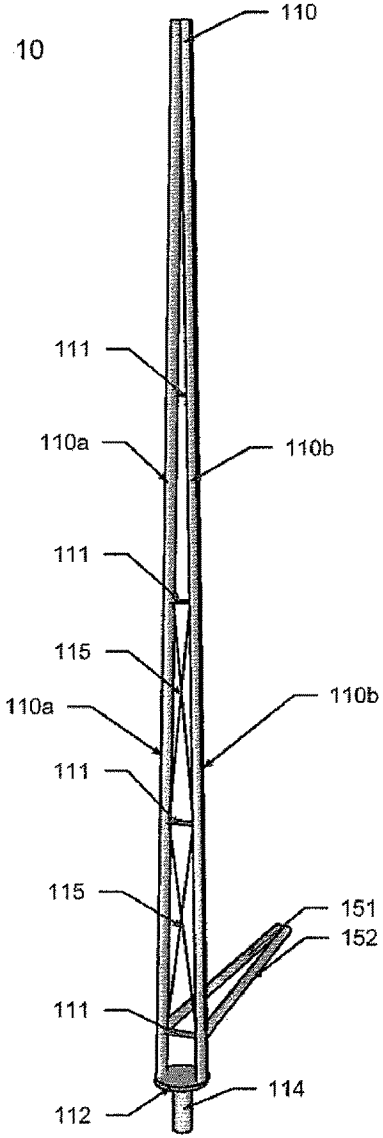
FIG. 10 schematically illustrates the vertical mast assembly in the vehicle of FIG. 9.

An important feature in the novel wind-propelled vehicle illustrated in FIGS. 9 and 10 is that the vertical upstanding mast (10 in FIGS. 1-8) is in the form of a vertical mast assembly, generally designated 110, which includes a pair of vertically-extending posts 110*a*, 110*b* joined together at their upper ends, diverging apart towards their lower ends, and connected together at the diverging lower ends by a plurality of struts 111 to define a substantially A-configuration frame. The lower ends of the two posts 110*a*, 110*b* are fixedly mounted on a rotatable plate 112 substantially aligned with the deck 113 of the vehicle, corresponding to deck 8 of hull 4 in FIG. 1. As shown particularly in FIG. 10, rotatable plate 112 includes a depending vertical shaft 114 rotatably mounted within the hull of the vehicle (e.g., in the same manner as illustrated in the prior art vehicle of FIG. 1).

The mast assembly 110 is further supported in the vertically-extending position by struts and shrouds, schematically shown at 111 and 115 in FIG. 10, connecting together opposite sides of the upper part of the two posts 110*a*, 110*b*. As shown particularly in FIG. 11, the two posts 110*a*, 110*b* are of substantially oval shape, having their long dimension in width extending in the fore-and-aft direction of the vehicle.

As indicated earlier, such a frame structure for the vertically-extending mast assembly is relatively rigid and less flexible than a free-standing mast, e.g., shown at 10 in the prior art vehicle of FIG. 1. Such a frame structure also enables the sail tracks to be fixed directly to the frame structure without need for extra special spreaders to support the tracks, as in the prior art vehicle of FIG. 1.

As in the prior art vehicle of FIG. 1, the wing-sail, generally designated 120 in FIG. 9, carried by the vertical mast assembly 110, is a light-weight, soft wing-sail including a fore sail panel 121 defining the leading edge of the wing-sail, and a pair of aft sail panels, one of which is shown at 122, defining the sides and trailing edge of the wing-sail.

Figure 11:
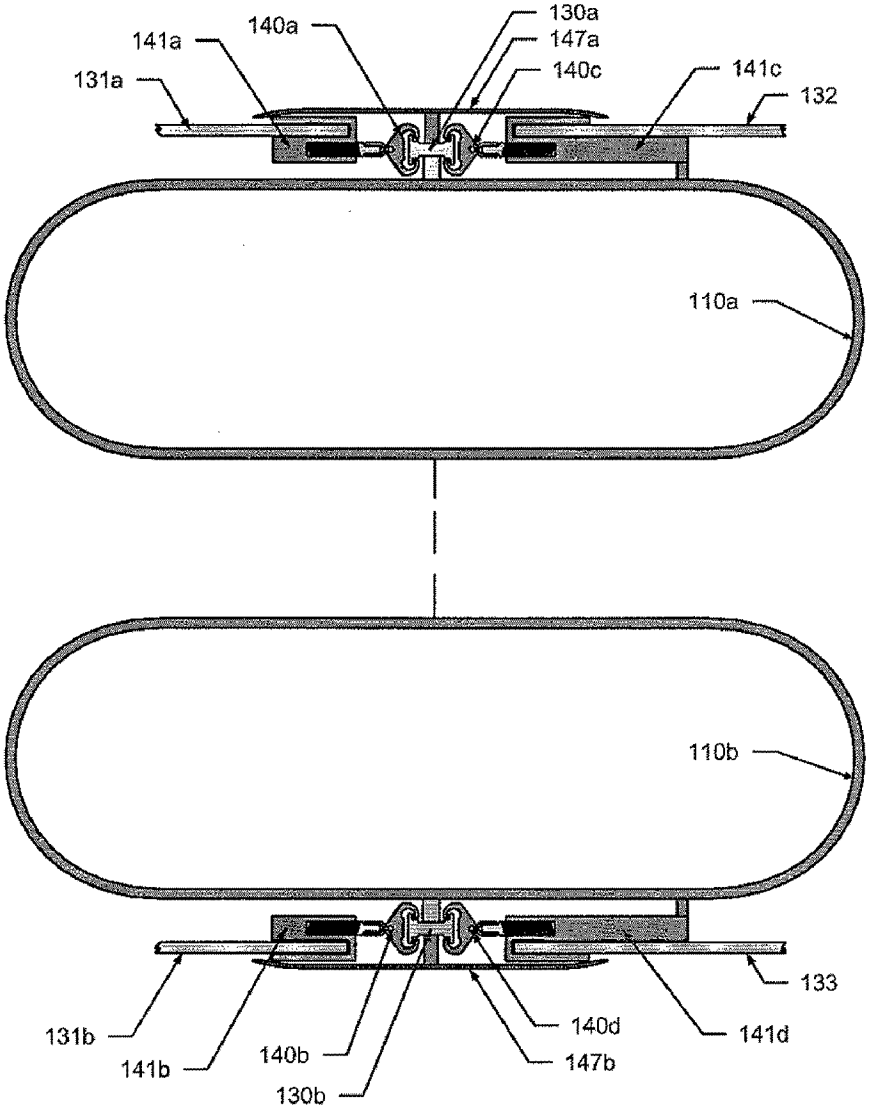
FIG. 11 schematically illustrates a transverse section of the wing sail of FIGS. 9 and 10, showing particularly the slidable connection of the wing sail to the two posts of the mast assembly.

Each post 110*a*, 110*b* of the vertical mast assembly 110 carries, on its outer edge, a sail track, shown in FIG. 11 at 130*a*, 130*b*, which slidably receive slider assemblies 140*a*, 140*b*, 140*c*, 140*d* fixed to the fore sail panel 121 and the two aft panels 122, 123. Thus, as shown in FIG. 11, slider assembly 140*a* is formed with a receptacle 141*a* for receiving one end 131*a* of batten 131 of the fore sail panel 121, and slider assembly 140*c*, with receptacle 141*c*, for receiving one end of batten 132 of the aft sail panels 122; whereas slider assembly 140*b* includes a receptacle 141*b* for fixedly receiving the opposite end 131*b* of the batten 131 of the fore sail panel 121, and slider assembly 140*d* with receptacle 141*d* for fixedly receiving one end of the batten 133 of the other aft sail panel 123.

Figure 12:
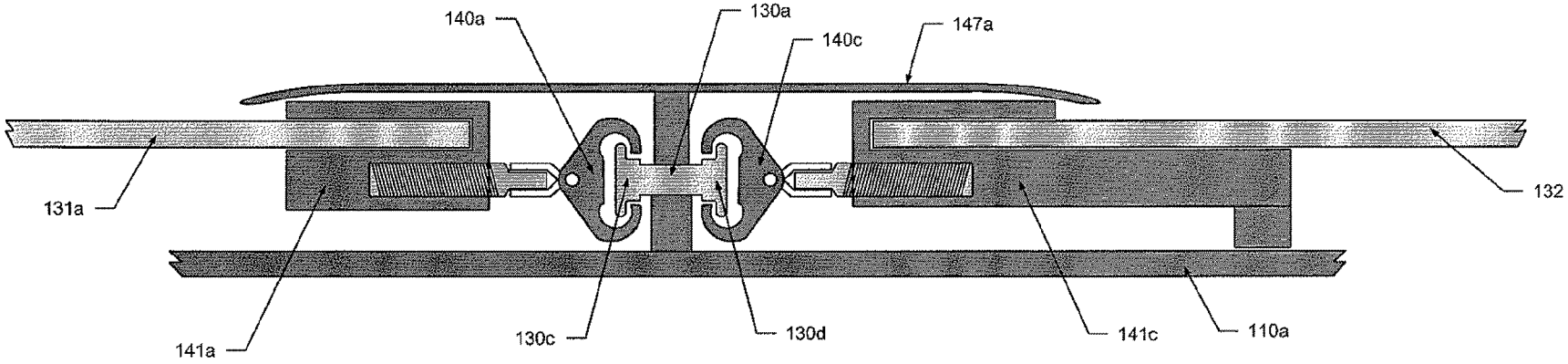
FIG. 12 is an enlarged view of one of the slide assemblies of FIG. 11.

FIG. 12 more particularly illustrates the construction of the tracks 130*a*, 130*b* and the slider assemblies 140*a*, 140*b*, 140*c*, 140*d*, cooperable therewith. Thus, as seen in FIG. 12 track 130*a* (similarly track 130*b* of FIG. 11) includes a pair of opposed, horizontally aligned rails 130*c*, 130*d*, and each of the slider assemblies (slider 140*a*, 140*c*, being seen in FIG. 12) slide along its respective rail 130*c*, 130*d*, and includes receptacle 141*a*, 141*c* for fixedly receiving the end of its respective batten 131*a*, 132.

The slider assemblies, (slider 140*a* and receptacle 141*a*, and slider 140*c* and receptacle 141*c*,) are covered by a cover plate 147*a*, and respective slider assemblies (slider 140*b*, receptacle 141*b*, and slider 140*d*, receptacle 141*d*) are covered by a cover plate 147*b*.

Such a construction permits the sails panels 121, 122, 123, to be hoisted and reefed independently, or together if so desired, as in the FIGS. 1-8 prior art vessel, but provides a more sturdy and simple structure since it obviates the need to install extra special spreaders to support the tracks.

As also clearly seen in FIGS. 9 and 10, a boom 151, 152 is attached to the lower end of each of the two posts 110*a*, 110*b* of the vertical mast assembly 110. These booms enable each of the aft sail panels of the wing-sail to be hoisted and reefed as a standard mainsail, in the manner described above with respect to the prior art vessel of FIGS. 1-8.

While the invention has been described with respect to one preferred embodiment in the form of a water vehicle, it will be appreciated that this is set forth merely for purposes of example. Thus, the invention could also be embodied in land or ice vehicles, and could also include other sail constructions, slider assemblies or track arrangements. Many other variations, modifications and applications of the invention may be made.

What is claimed is:

1. A wind-propelled vehicle, comprising:

a vertical mast assembly having a lower end rotatably mounted about a vertical axis on the vehicle;

and a wing-sail carried by said vertical mast assembly for propelling the vehicle, said wing-sail including a fore sail panel defining a leading edge of the wing-sail, and a pair of aft sail panels defining sides and a trailing edge of the wing-sail;

characterized in that said vertical mast assembly includes: a pair of vertically-extending posts joined together at their upper ends, diverging apart towards their lower ends, and connected together at said diverging lower ends to define a frame of an A-configuration; and a rotatable support for the diverging lower ends of the pair of posts to said vehicle; and a separate boom fixed to the lower end of each of said pair of posts connected to the aft sail panels of said wing-sail enabling each aft sail panel to be hoisted and reefed.

2. The wind-propelled vehicle according to claim 1, wherein said rotatable support includes a rotatable horizontal plate having an upper surface to which the lower diverging ends of the posts are mounted, and an under surface to which is fixed a vertical shaft rotatably mounted on said vehicle.

3. The wind-propelled vehicle according to claim 2, wherein said vehicle includes a hull and a deck, said vertical mast assembly being mounted in a free-standing manner with said rotatable plate substantially aligned with said deck, and with said shaft penetrating said deck and rotatably supported within said hull.

4. The wind-propelled vehicle according to claim 1, wherein said pair of vertically-extending posts are connected together at their diverging lower ends by reinforcing struts.

5. The wind-propelled vehicle according to claim 4, wherein said vertical mast assembly is supported in said vertically-extending position by struts and shrouds connecting together opposite sides of an upper part of the vertical mast assembly.

6. The wind-propelled vehicle according to claim 1, wherein said wing-sail is of sail cloth; and said posts of the vertical mast assembly include a pair of tracks extending along opposite sides thereof and slidably receiving slider assemblies fixed to said fore and aft sail panels to permit hoisting and reefing of the wing-sail.

7. The wind-propelled vehicle according to claim 6, wherein there are a plurality of slider assemblies for each post fixed to said fore and aft sail panels and independently slidably received in said pair of tracks to permit independent hoisting and reefing of the sail panels of the wing-sail.

8. The wind-propelled vehicle according to claim 7, wherein each of said tracks includes a pair of opposed, horizontally-aligned rails, and each of said slide assemblies includes a slide slidably received on one of said rails, and a batten receptacle for fixedly receiving a batten at an edge of the respective sail panel.

9. The wind-propelled vehicle according to claim 1, wherein said posts are of substantially oval shape having their long dimensions in width extending in a fore and aft direction of the vehicle.

10. The wind-propelled vehicle according to claim 1, wherein each of said booms includes a slider coupled between the boom and a trailing edge of each aft sail panel such as to permit rearward tensioning and independent sliding of the trailing edges along the respective boom when changing the airfoil shape of the wing-sail by changing the angle of the boom around the vertical mast assembly.

11. The wind-propelled vehicle according to claim 10, wherein said sliders include a clew at a trailing edge of each of said aft sail panels.

* * * * *